United States Patent [19]

White, Jr.

[11] 3,964,842

[45] June 22, 1976

[54] HYDRAULIC DEVICE

[75] Inventor: Hollis N. White, Jr., West Lafayette, Ind.

[73] Assignee: TRW Inc., Cleveland, Ohio

[22] Filed: Jan. 20, 1975

[21] Appl. No.: 542,574

[52] U.S. Cl. ..... 418/15; 418/61 B

[51] Int. Cl.[2] ..... F01C 1/02; F03C 3/00; F04C 1/02

[58] Field of Search ..... 418/15, 61 B; 60/384

[56] References Cited

UNITED STATES PATENTS

| | | | |
|---|---|---|---|
| 3,286,645 | 11/1966 | Albers | 418/15 |
| 3,627,454 | 12/1971 | Goff et al. | 418/61 B |
| 3,671,154 | 6/1972 | Kolbe et al. | 418/61 B |
| 3,873,248 | 3/1975 | Johnson | 418/61 B |
| 3,910,733 | 10/1975 | Grove | 418/61 B |

OTHER PUBLICATIONS

*Russian Engineeering Journal*, Issue 5, 1965.

*Primary Examiner*—John J. Vrablik

[57] ABSTRACT

A hydraulic device of the type in which an internally toothed first gear and an externally toothed second gear eccentrically located within said first gear are supported for relative rotary and orbital movement. The gear teeth of the first and second gears define pockets or chambers which expand from a minimum volume to a maximum and again contract to said minimum volume upon relative rotational and orbital movement thereof. A commutation valve arrangement in synchronism with said relative rotary and orbital movement connects the expanding pockets with one side of a fluid pressure system and connects the contracting pockets with the other side of the fluid pressure system. The commutation valve arrangement directs fluid to and from said pockets from one axial side thereof, and an additional valve arrangement is provided for directing fluid into the pockets from the other axial side thereof, the additional valve arrangement being responsive to the fluid pressure in the pockets.

6 Claims, 9 Drawing Figures

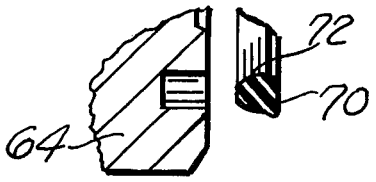
FIG. 8
FIG. 9
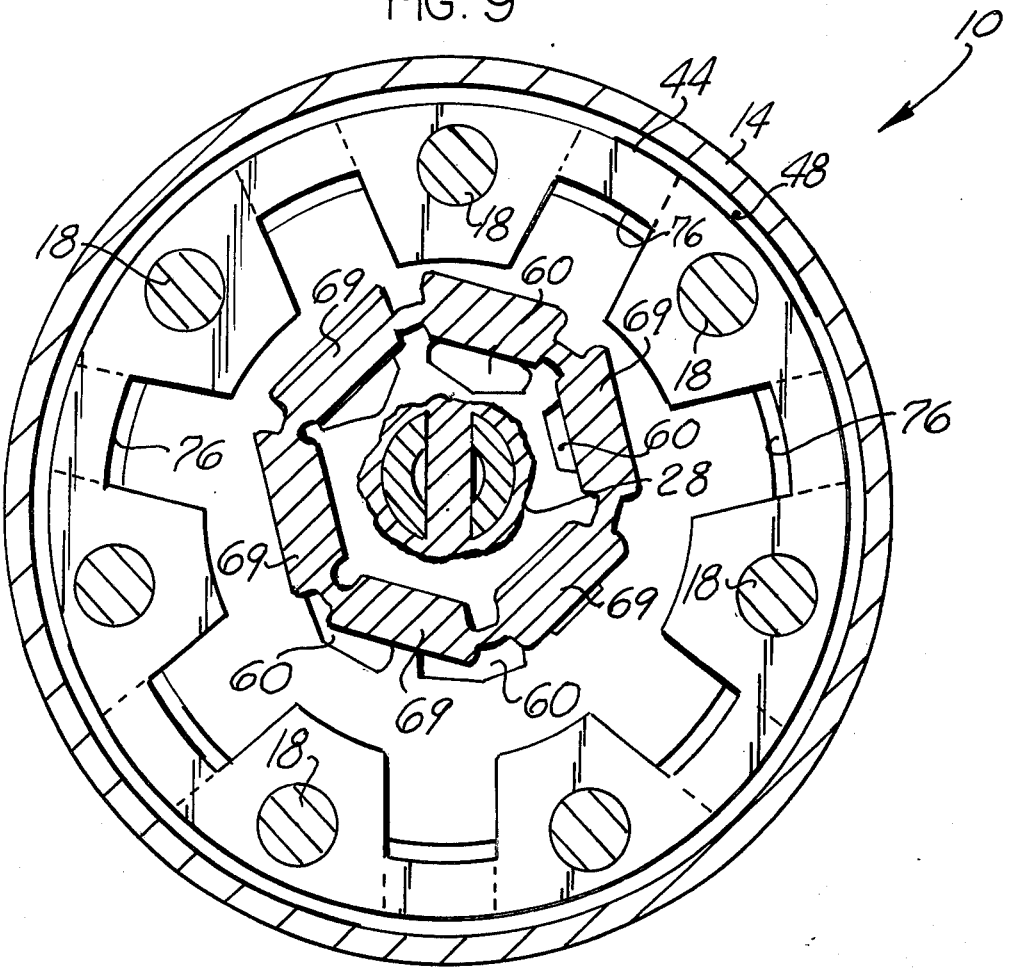

HYDRAULIC DEVICE

BACKGROUND OF THE INVENTION

This disclosure relates to hydraulic devices of the expanding, contracting-chamber type and particularly to hydraulic devices in which the chambers are formed by a gerotor gearset.

Typically, such hydraulic devices have utility as both motors and as pumping devices and conventionally include commutation-valve arrangements for directing fluid to and from the chambers from one axial side of the gerotor gearset. Illustrative of such a hydraulic device is U.S. Pat. No. 3,452,680, patented July 1, 1969, and assigned to the assignee of the present invention. The commutation-valve arrangements which are generally used with such devices often include a fairly complex series of fluid channels, and in order to properly distribute and remove the fluid in proper sequence from the chambers, some of the channels are necessarily of fairly small dimension. Therefore, it has been found that such hydraulic devices, particularly when employed as pumping units, are at times subject to operating at less than full volumetric efficiency when the fluid, due to the complex path it follows through the commutation-valve arrangement, is insufficient to fully fill the chambers during their expansion cycles.

BRIEF DESCRIPTION OF THE PRESENT INVENTION

According to the present invention, a hydraulic device is provided in which hypocycloidally movable members of a gerotor gearset define the expanding and contracting chambers of the device. A commutation-valve arrangement is provided which delivers fluid to and from one axial side of the gearset. A second fluid arrangement is provided which communicates with the chambers from the other axial side of the gerotor gearset. This second form of fluid control arrangement preferably takes the form of a plurality of fluid check valves, each in fluid communication with a respective chamber of the gerotor gearset, and each being solely responsive to the fluid pressure (and therefore the volume of fluid) in a respective chamber to supplement the flow of fluid into any chamber which is not operating at full volumetric capacity.

The second fluid control arrangement is continually in condition to supplement fluid into a respective chamber when the fluid volume in that chamber is insufficient to maintain the valve in its closed position. A series of fluid passageways are provided, each of which communicates with a respective chamber, and each of which also communicates with a common source of fluid. Each check valve preferably takes the form of a ball check valve in each passageway which is balanced solely by the fluid pressure at the common source and fluid pressure in the chamber. The second fluid control arrangement is thereby continually responsive to the condition of all of the chambers and operates to deliver fluid from the common source to whichever chamber is undergoing expansion.

DESCRIPTION OF THE DRAWINGS

Other objects and advantage of the present invention will become more apparent from the following description and the accompanying drawings wherein:

FIG. 8 is an enlarge fragmentary sectional view of a portion of the area 8 of FIG. 1 and showing a seal member employed in the preferred embodiment of the present invention; and FIG. 9 is a view similar to FIG. 7 and disclosing an alternative configuration for the commutation valve arrangement.

DESCRIPTION OF AN EMBODIMENT OF THE PRESENT INVENTION

Figure 1:
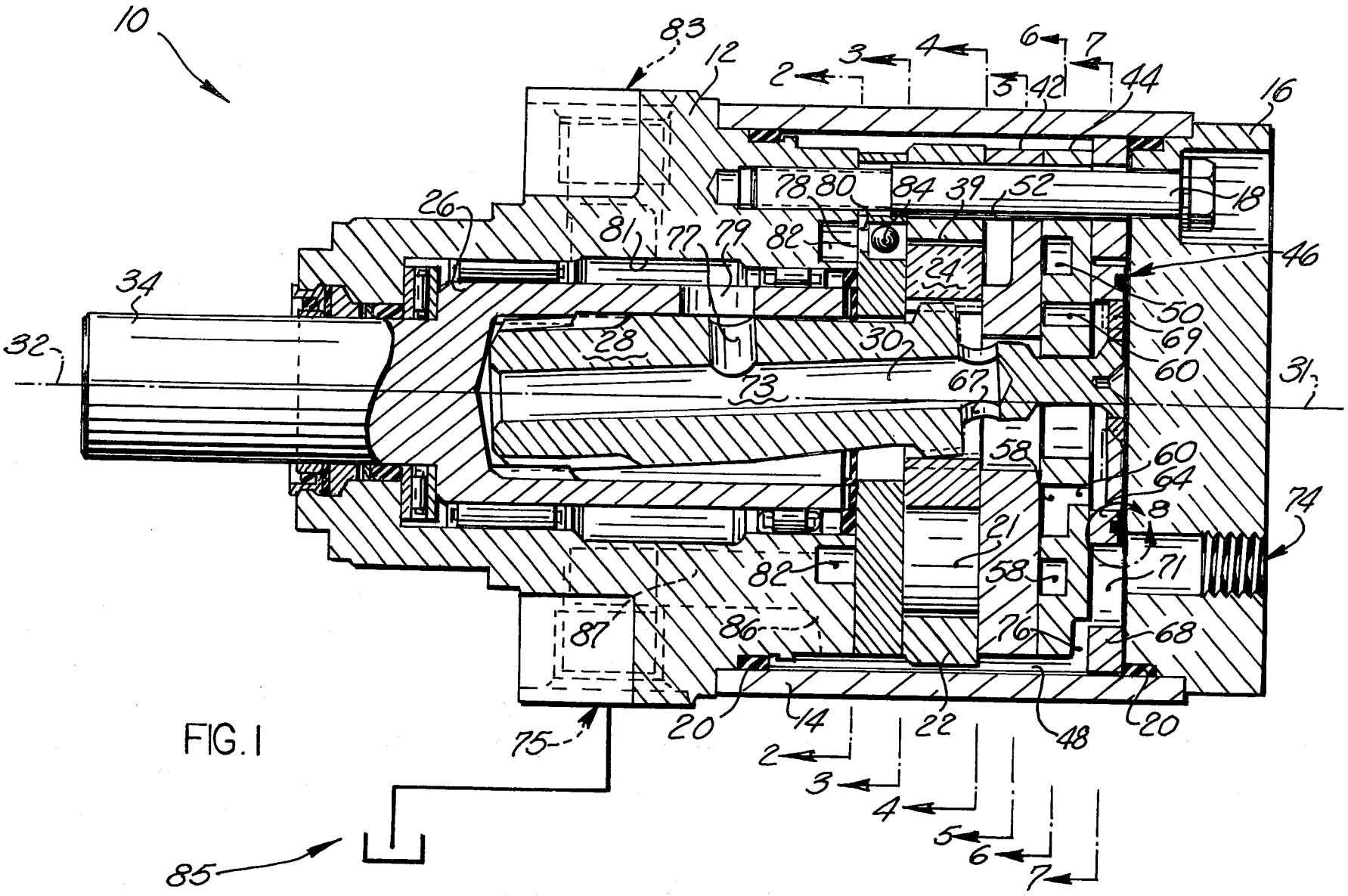
FIG. 1 is a cross-sectional view of a hydraulic device constructed in accordance with the present invention.
Figure 2:
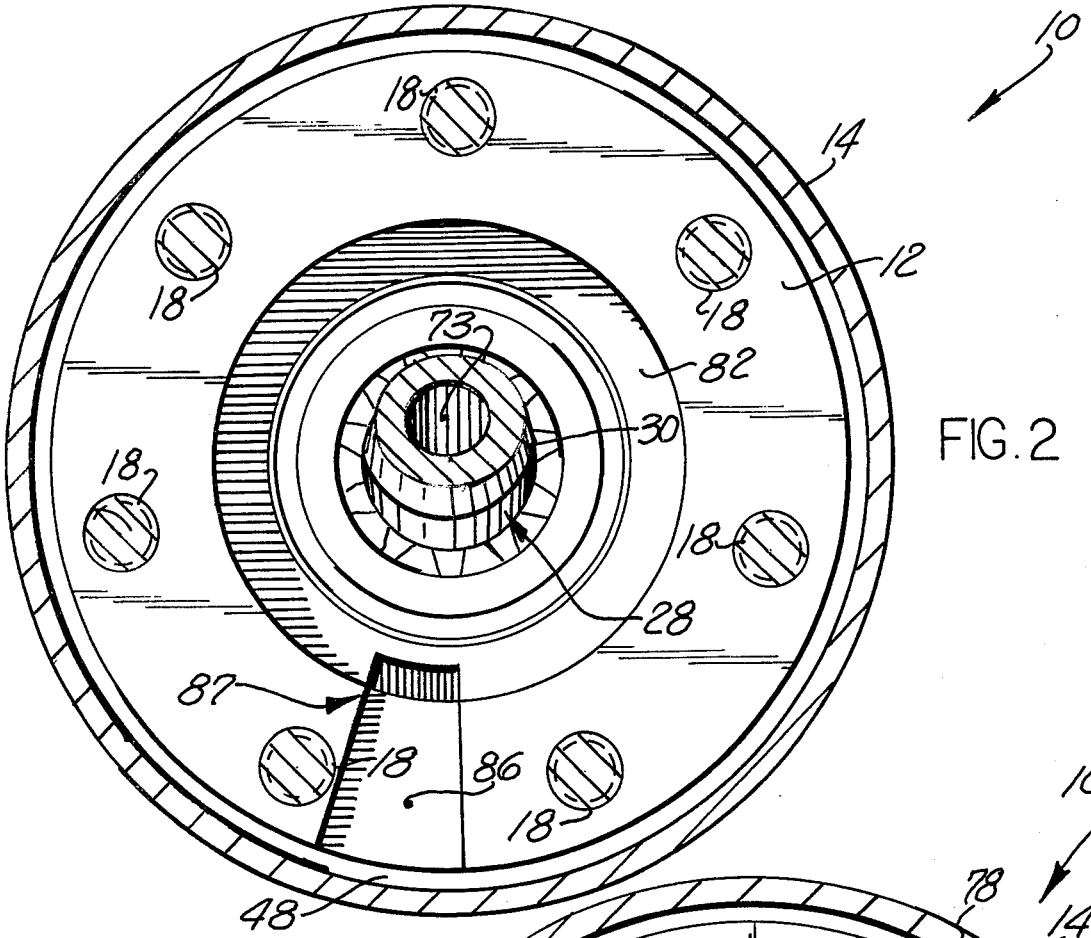
FIGS. 2 through 7 are sectional views taken along lines 2—2; 3—3; 4—4; 5—5; 6—6; and 7—7, respectively, of FIG. 1.
Figure 3:
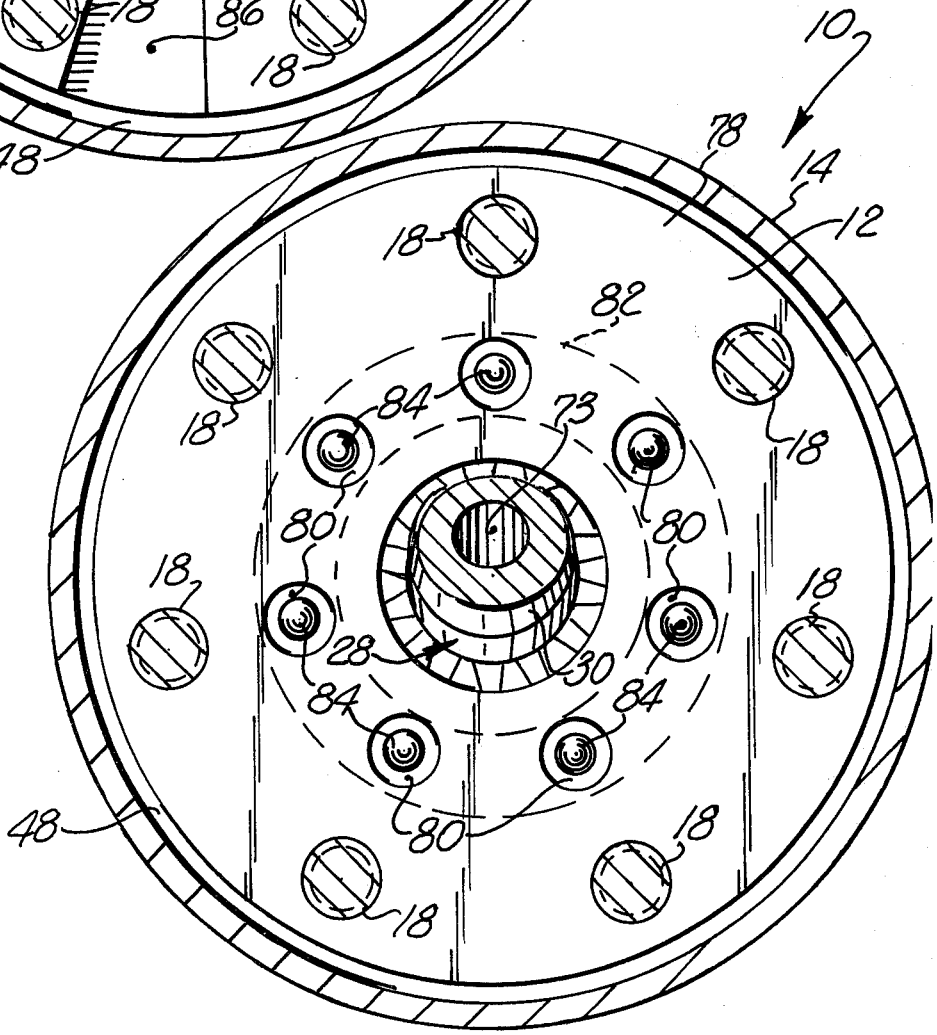
Figure 4:
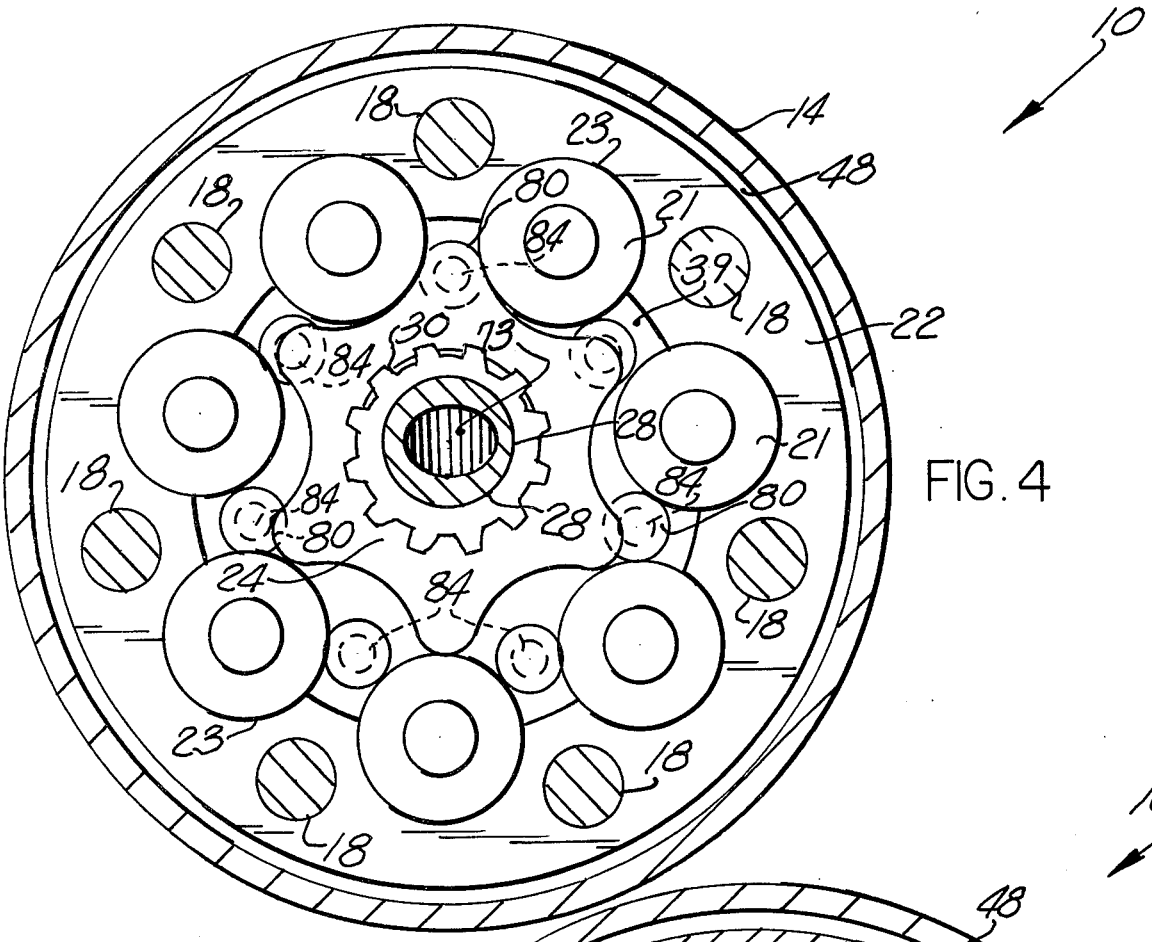

Referring to FIGS. 1 through 7, a hydraulic device is indicated generally by the numeral 10 and includes housing assembly 12. Cylindrical casing 14 encircles both a portion of the housing assembly as well as a number of parts of the hydraulic device to be described hereinafter. The cylindrical casing 14 is retained in position on the housing by means of an end cover 16 and a plurality of bolts 18 which extend therethrough and whose threaded end portions engage corresponding threaded portions of the housing assembly 12.

A pair of sealing rings 20 provide seals between the casing 14 and the housing assembly 12, and between the casing 14 and the end cover assembly 16.

The expandable and contractable chambers of the hydraulic device are preferably formed by a gerotor gearset having an internally-toothed fixed stator gear, and an externally toothed rotor. As may be clearly seen from FIGS. 1 and 4, the fixed stator includes an annular member 22 having an external-circumferential wall which is spaced from the inner-circumferential wall of the casing 14. The teeth of the stator gear are formed by cylindrical rollers 21 which are rotatably supported by appropriately dimensioned cylindrical recesses 23 in the annular member 22. The areas between the rollers 21 are considered the fluid chambers or pockets 39 and, as may be seen by reference to FIG. 1, those chambers extend axially relative to the geometric axis 31 of the annular member 22.

The externally toothed rotor 24 has one less tooth than the stator. The rotor is eccentrically mounted relative to the stator and is supported for both rotational and orbital motion relative to the stator.

The aforesaid motion of the rotor is generally referred to as hypocycloidal and by this movement the rotor operates to expand and contract the chambers 39. Referring specifically to FIG. 1, the rotor 24 is connected to a drive sleeve 26 by means of a wobble-shaft 28. The wobble-shaft 28 is splined at one end to a correspondingly splined portion of the drive sleeve 26, and rotates therewith. The axis of rotation 30 of the wobble-shaft 28, which axis also forms the axis of rotation of the rotor 24, is angularly disposed relative to the axis of rotation 32 of drive shaft 34. The wobble-shaft 28 is also splined near its other end to corresponding splines of the rotor 24 so that the rotor rotates therewith. The splines at both ends of the wobble shaft are curved slightly to afford limited universal pivotal movement of the shaft 28 with respect to the drive sleeve 26 shaft, and the rotor. Engagement of the rotor teeth with the rollers 21 provide seals between the expanding and contracting chambers 39 in a manner which is known in the art and need not be further elaborated upon and which is described in detail in U.S. Pat. No. 3,286,602.

By means of the foregoing construction, when the hydraulic device is used as a pump, rotation of the drive shaft 34 and the corresponding movement of the wobble-shaft 28 serves to apply a driving torque to the rotor 24. With application of such a driving torque to the rotor, the rotor both rotates and orbits relative to the stator thereby expanding and contracting the chambers 39 and resulting in fluid flow to and from the chambers. The detailed motion of the rotor is also known and described somewhat in U.S. Pat. No. 3,286,602. In general, in the described embodiment the rotor orbits 6 times (equal to the number of teeth thereon) for each revolution of shaft 34. Each orbit will produce seven pressure pulses. At any one instant of time, there are 3+ pockets contracting and 3+ pockets expanding.

The directing of fluid to and from the chambers 39 must be properly timed in sequenced relation in order for the hydraulic device to operate. In order to achieve the properly timed delivery of fluid to and from the expanding and contracting chambers 39 there is provided a commutation-valving arrangement.

In the preferred embodiment of the present invention, the commutation-valving arrangement may be similar to that shown in the aforesaid U.S. Pat. No. 3,452,680 and includes a pair of fixed plates 42,44 and a movable commutator-valve plate 46. The fixed plates 42, 44 are circularly shaped and have diameters approximately equal to the diameter of the outer wall of the annular member 22, and define part of an axially-extending, fluid-flow passageway 48 between the outer peripheries of the plates and the inner wall of the casing 14.

Figure 5:
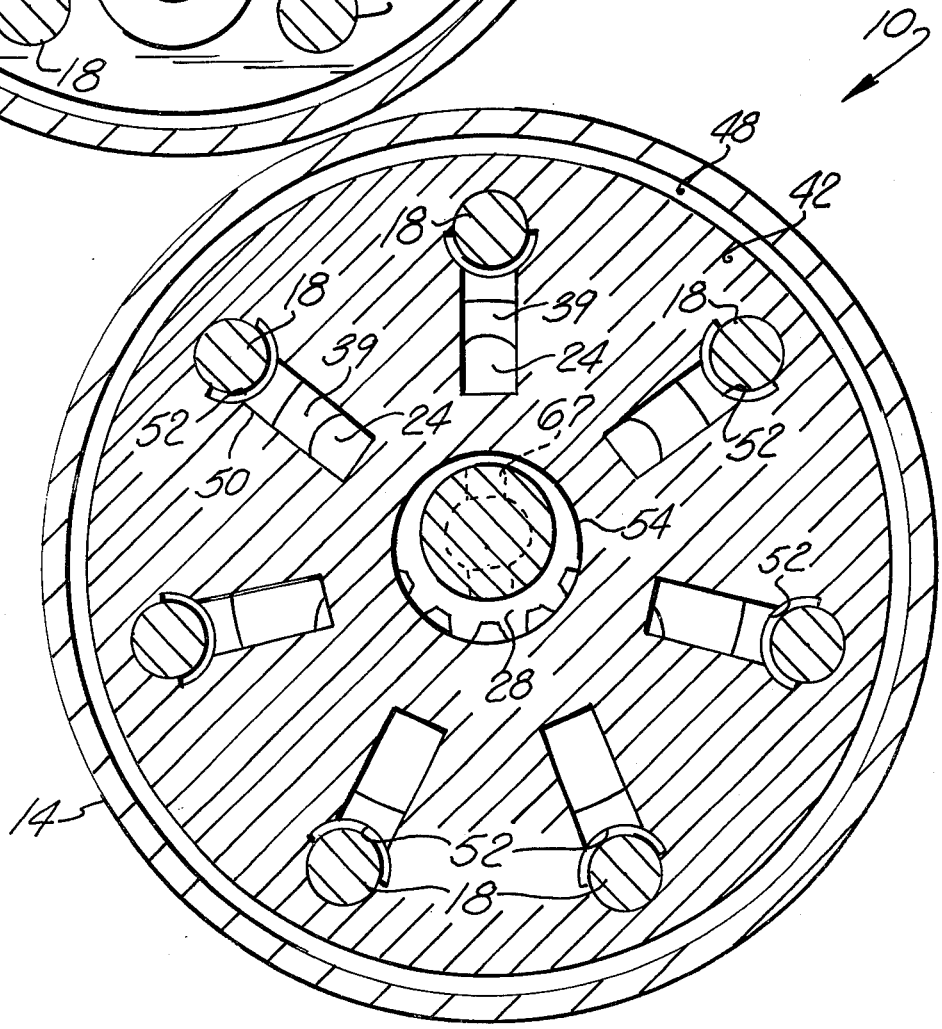

Referring to FIGS. 1 and 5, stationary plate 42 is immediately adjacent the annular member 22 and includes a plurality of radial-flow passageways 50 formed in one face of the plate. These passageways 50 correspond in number to the number of fluid chambers 39 formed between the rotor and the stator and are in open fluid communication with those chambers. Each passageway 50 is also in fluid communication with an enlarged radial portion 52 of a corresponding bore which extends through plate 42 and which receives the shanks of the clamping bolts 18. The plate 42 includes a central aperture 54 through which the wobble shaft 28 extends.

Figure 6:
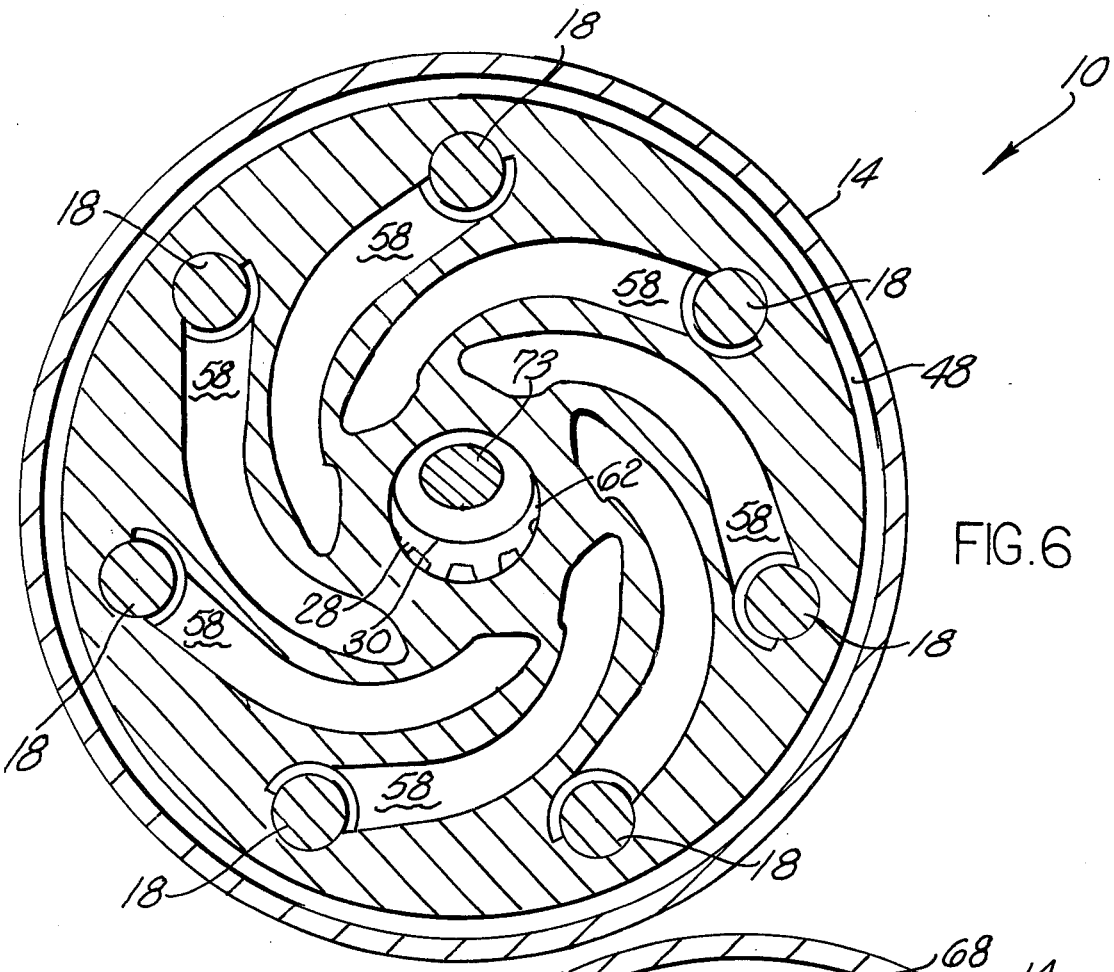

Referring to FIGS. 1 and 6, the other stationary or manifold plate 44 also includes a series of circumferentially-spaced axially extending bores which receive the shanks of the clamping bolts 18 and which include enlarged radial portions 56. Such radial portions 56 of the bores are in communication with a corresponding number of doglegged grooves 58 formed in one face of plate 44. These grooves are directed inwardly from a corresponding bore 56 and their inner end portions communicate with corresponding axial passages 60 of limited cross-sectional area and which include portions formed in an opposite face of the plate 44. A concentric bore 62 extending axially through plate 44 permits the wobble shaft to extend therethrough.

Figure 7:
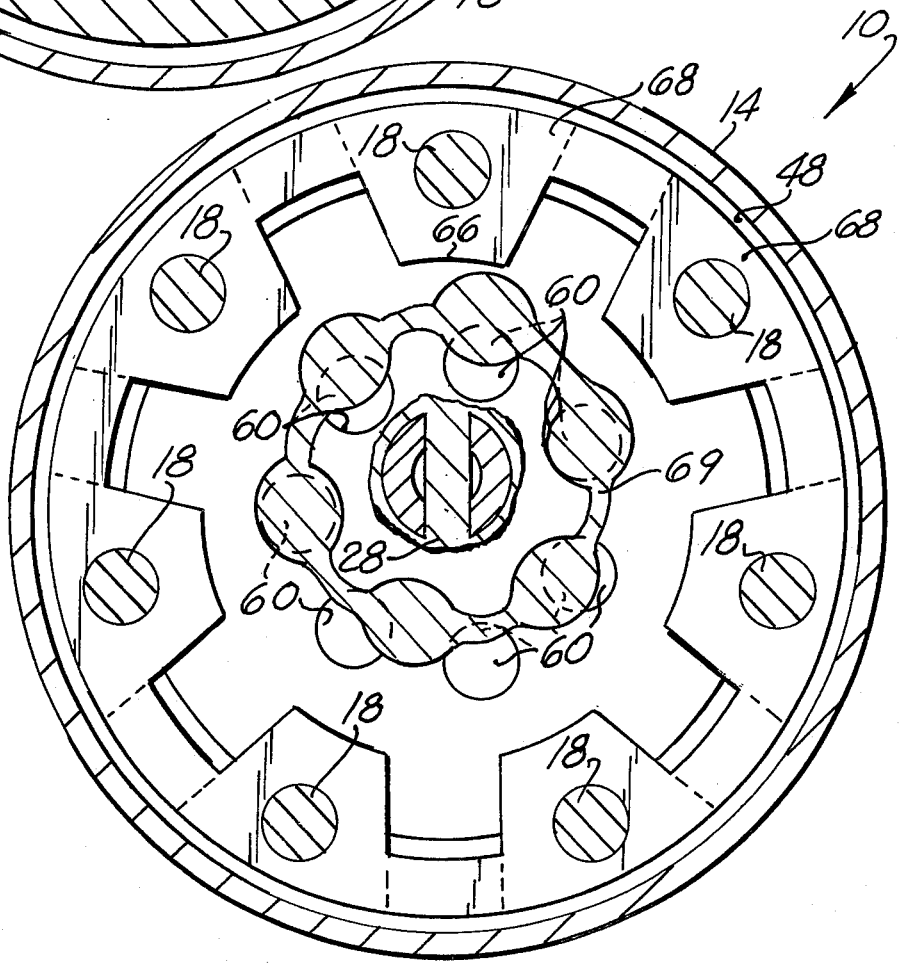

Referring to FIGS. 1 and 7, movable commutator valve plate 46 comprises a generally annular shaped member 64 which has an outer wall diameter substantially less than the diameter of an inner wall 66 of a fixed plate 68 which encircles it. The annular shaped member 64 includes a valve control surface 69 for opening and closing the ports 60 in the proper sequence. FIG. 8 shows an alternative shape for the valve control surface 69 and in the embodiments of FIGS. 7 and 8 it may be noted that the shape of surface 69 generally corresponds to the shape of ports 60.

To prevent leakage between commutator plate 46 and end plate 16 there is provided a seal assembly, shown in enlarged fragmentary cross section in FIG. 8, and which includes an annular wear member 70, and a sealing element 72 which is preferably made of Teflon[R] and which is received in a corresponding groove in annular member 64. Further details of a suitable sealing assembly may be had by reference to the aforesaid U.S. Pat. No. 3,452,680.

Fluid is directed into the inlet chamber 71 between the movable commutator-valve plate 46 and the inner wall of the stationary plate 68 which surrounds it by means of an inlet opening 74. The inlet opening 74 is formed in the end plate 16 and is in direct communication with the aforesaid inlet chamber 71. A second inlet opening 75 is formed in the housing and communicates with the fluid passageway 48 in the manner to be described hereinafter. The fluid passageway 48 communicates with inlet chamber 71 through a plurality of passages 76 formed in manifold plate 44. As should be clear from the foregoing discussion, the fluid flow which enters the hydraulic device through inlet opening 74 is directed into and out of the pockets by means of the commutation valve arrangement and enters and exits the chambers from one axial side thereof.

Fluid which exits the chambers 39 through the commutation valve assembly is directed through bores 62 and 54 in the stationary valve plates. The fluid then flows into the center of the wobble shaft through bore 67, and thereafter through bores 73 and 77 in the wobble shaft, bore 79 in the drive sleeve, bore 81 in the housing 12 and then to outlet 83.

In accordance with the present invention, there is provided a second valving arrangement on the other axial side of the chambers 39, which valving arrangement serves to supplement the fluid flow into the chambers 39 to insure filling the full volume of the chambers 39 during expansion thereof.

This second valve arrangement is shown in FIGS. 1 through 4 and includes a fixed plate 78 adjacent the other axial side of the stator. This plate is fixedly supported relative to housing 12 by means of the bolts 18 and includes a series of axially extending fluid passageways 80 therein. The number of passageways 80 is equal to the number of fluid chambers 39, and each such passageway is in direct communication with a respective chamber.

Also formed in a portion of the housing 12 is an annular fluid channel 82. This fluid channel is dimensioned so that it is in constant fluid communication with all of the fluid passageways 80 in the fixed plate 78. As may be clearly seen from FIG. 1, the portions of the fluid passageways 80 adjacent this annular fluid channel are dimensioned so that their diameters are slightly less than a ball check valve 84 which is located in each fluid passageways 80.

Each ball check valve 84 floats freely in the passageway 80 and is balanced by fluid pressure in the channel 82 and in a respective chamber. The axial location of each ball check valve 84 is therefore determined by the relative fluid pressures in the annular channel 82 and in the chamber 39 with which the ball check valve 84 is aligned.

When the hydraulic device is operated as a pump, the device is generally employed in a closed fluid circuit, in which fluid enters the device through inlet port 74 and is directed into and out of the chambers 39 by means of the commutation valve arrangement set forth heretofore and exits the device through outlet port 83.

Fluid from a reservoir or other similar source represented schematically by the member 85 in FIG. 1 communicates with the hydraulic device through the second inlet port 75 and is directed to the annular fluid channel 82 in the housing by means of fluid passageway 87 in housing 12. The housing also includes a channel 86 which directs fluid from the second inlet port 75 into the fluid passageway 48 between the casing and the aforesaid valve plate members. In a closed loop fluid circuit outlet fluid above a predetermined pressure can be diverted from outlet 83 and used to supply the reservoir 85, as is known. Alternatively, the reservoir 85 can be provided with a separate fluid supply.

As the fluid is directed through the commutation valve arrangement and into and out of the axially extending chambers from the one axial side of the chambers adjacent the commutation valve arrangement, the valving arrangement on the other axial side of the chambers will serve to insure that the chambers will operate at or close to full volumetric efficiency. Since the fluid passageways in the stationary plate 78 are always aligned with a respective fluid chamber, those passageways are always capable of supplying fluid to the chamber in the event that the flow of fluid to or from the commutation valve arrangement is not of optimum proportions. With the check valve arrangement in accordance with the present invention, if the fluid entering an expanding chamber through the commutation valve arrangment is insufficient to seal the check valve, fluid enters the chamber from both the commutation valve arrangement as well as the check valve arrangement. Conversely, as the pocket contracts and the fluid pressure therein accordingly increases, this fluid pressure serves to urge the ball check valve in a direction which closes its associated fluid passageway so that high pressure fluid only exhausts through the commutation valve arrangement and fluid from reservoir 85 is concentrated on those chambers which are undergoing expansion and which are not completely filled.

In this manner the valving arrangement on the axial side of the chamber opposite to that of the commutation valve arrangment is continually responsive to fluid pressure throughout the chambers and is controlled completely by such pressure in such a manner as to supplement fluid flow into any expanding chamber which does not receive sufficient fluid from the commutation valve arrangement. This results in both a more efficient output for the pump as well as an insurance against damage to parts of the pumping unit due to inadequate fluid flow therethrough.

What is claimed is:

1. A hydraulic device comprising an internally toothed first gear and an externally toothed second gear eccentrically located within said first gear, means supporting said gears for relative rotary and orbital movement, the number of teeth of said second gear being one less than the number of teeth on said first gear, the form of the gear teeth of said first and second gears being such that relative rotary and orbital movement occurs while said gears are supported and guided by the meshing teeth thereof, the gear teeth of said first and second gears defining pockets which expand from a minimum volume to a maximum volume and then contract to said minimum volume upon relative rotational and orbital movement thereof, commutation valve means for connecting said expanding pockets with one side of a fluid pressure system and for connecting said contracting pockets with the other side of the fluid pressure system in synchronism with said relative rotary and orbital movement of said first and second gears, said commutation valve means including means for directing fluid to and from said pockets from one axial side thereof, and valve means for selectively directing fluid into any expanding pocket from the other axial side thereof in response to the fluid pressure in said expanding pocket falling below a predetermined level and for blocking fluid flow out of any contracting pocket from said other axial side thereof in response to the fluid pressure in said contracting pocket rising above a predetermined level.

2. A hydraulic device of the type set forth in claim 1 wherein said valve means includes a plurality of valves each associated with a respective pocket, each of said valves being in constant fluid communication with a common fluid supply.

3. A hydraulic device of the type set forth in claim 1 wherein said valve means includes a plurality of axially extending fluid passageways having first end portions aligned with respective ones of said pockets and second end portions in communication with a common fluid supply, and a ball check valve in each of said fluid passageways and disposed to permit fluid flow through a fluid passageway into its respective pocket when the fluid pressure in the pocket falls below a predetermined level and to block fluid flow out of its respective pocket when the fluid pressure in the pocket rises above a predetermined level.

4. A hydraulic device as set forth in claim 3 including a valve plate member having first and second sides, said valve plate being disposed with its first side adjacent said other axial side of said pockets, said fluid passageways being formed in said valve plate and extending from said first side to said second side of said valve plate.

5. A hydraulic device as set forth in claim 4 wherein said common fluid supply comprises an annular fluid channel disposed adjacent said second side of said valve plate, said hydraulic device including first and second fluid inlet ports, said first fluid inlet port being in direct fluid communication with said annular fluid channel, said second fluid inlet port being in direct fluid communication with an inlet chamber which is in fluid communication with said commutation valve, and fluid passage means for placing said annular channel in direct fluid communication with said inlet chamber.

6. A hudraulic device comprising first and second meshing gears, means supporting said gears for relative rotary and orbital movement, the gear teeth of said gears defining pockets which expand and contract upon said relative rotary and orbital movement and which define pockets for receiving fluid upon expansion thereof and for forcing fluid thereform upon contraction thereof, first valve means for directing fluid into said expanding pockets from one axial side thereof and for directing fluid from said one axial side from said contracting pockets, and said valve means located at the other axial side of said pockets for directing fluid flow into said pockets from said other axial side upon expansion of said pockets, said second valve means comprising a plurality of valve members associated with respective pockets and each of which is movable to an open position to permit fluid flow therepast into its associated pocket in response to the fluid pressure in its associated pocket falling below a predetermined level.

* * * * *